United States Patent [19]

Brakhage, Jr. et al.

[11] 4,437,643

[45] Mar. 20, 1984

[54] RAM-TYPE BLOWOUT PREVENTER

[75] Inventors: William L. Brakhage, Jr.; William M. Taylor, both of Houston, Tex.

[73] Assignee: Cameron Iron Works, Inc., Houston, Tex.

[21] Appl. No.: 277,231

[22] Filed: Jun. 25, 1981

[51] Int. Cl.[3] ..... E21B 33/06

[52] U.S. Cl. ..... 251/1 A; 254/29 A; 92/128

[58] Field of Search ..... 251/1 A, 1 R; 92/13.6, 92/169, 128; 254/29 A

[56] References Cited

U.S. PATENT DOCUMENTS

| | | | |
|---|---|---|---|
| 3,272,222 | 9/1966 | Allen | 251/1 A |
| 3,647,174 | 3/1972 | LeRouax | 251/1 A |
| 4,268,011 | 5/1981 | Randall | 254/29 A |

*Primary Examiner*—Martin P. Schwadron
*Assistant Examiner*—Sheri Novack
*Attorney, Agent, or Firm*—Vinson & Elkins

[57] ABSTRACT

An improved blowout preventer having a body with a vertical bore and opposed aligned guideways extending out from the bore, a pair of studs secured to the body, one at each side of each guideway and extending into the bonnets closing the guideways, a cylinder in each bonnet, a piston in each cylinder, a rod extending from each piston and connecting to a ram in its guideway, pressure responsive means connecting between the body and each bonnet for urging the bonnets toward and away from the body, nuts rotatable and captured in the bonnets and threaded onto the studs to retain the bonnets in position on the body and means for supplying hydraulic pressure to the cylinders to move the rams and to the pressure responsive means to move the bonnets. In one form of the invention, the studs coact as a part of the pressure responsive means for urging the bonnets toward the body and are hydarulically tensioned thereby.

5 Claims, 7 Drawing Figures

2
2
10
12
14
16
18
20
22
24
28
30
32
34
36
38
40
42
44
46
48
50
70
102

3
3
10
14
18
22
26
30
32
34
36
40
42
44
46
48
50
52
54
56
58
60
61
62
64
66
68
69
70
72
74
76
78
80
82

RAM-TYPE BLOWOUT PREVENTER

BACKGROUND

Blowout preventers of the ram-type have been provided with resilient packers which after use are often replaced. Such replacement has generally required that the bonnets be disconnected from the body and the rams pulled out of the body guideways. Such replacement procedure has generally required the removal of a minimum of four bolts or fasteners for each bonnet and the reinstallation and proper tensioning of such fasteners to secure the bonnets to the body.

One effort made to improve the ease of changing packers is illustrated on page 1438 of the 1980–81 *Composite Catalog* of Oil Field Equipment and Services, published by World Oil. This illustrates the hydraulic control system of Type "U" Preventers of Cameron Iron Works, Inc. Such system provides a pair of piston and cylinder connections between each of the bonnets and the body which utilize hydraulic pressure to move the bonnets away from the body or toward the body on tubes secured to the body. Ram closing hydraulic pressure is used to open the bonnets and ram opening pressure is used to close the bonnets. Such bonnet movement is prevented by the installation of four bolts in each bonnet which secure the bonnet to the body. After each packing change in this type preventer, eight bolts must be tightened and properly tensioned solely by the mechanical rotation of the bolts.

SUMMARY

The present invention provides an improved ram-type blowout preventer having two studs for connecting each bonnet to the body and in one form with the studs functioning as a part of a pressure responsive means to urge their bonnet against the body and the studs are hydraulically tensioned thereby. Only two nuts are used for securing each bonnet and because of the hydraulic tensioning of the studs in one such form, a minimum of mechanical tensioning of the nuts is required. The nuts are rotatable in the bonnets but are prevented from inadvertent removal from the bonnet by suitable means. An additional pressure responsive means is provided to urge the bonnets away from the body when the nuts have been unthreaded from the studs.

An object of the present invention is to provide an improved ram-type blowout preventer in which the changing of the ram packing is relatively quick and simple.

Another object is to provide an improved ram-type blowout preventer in which the means fastening the bonnets to the body are at least partially hydraulically tensioned.

A further object is to provide an improved ram-type blowout preventer having improved means for moving the bonnets toward and away from the body.

Still another object is to provide an improved ram-type blowout preventer having nuts and studs for securing the bonnets to the body in which loss or misplacement of the nuts is avoided and they are ready and aligned for tightening on the studs when the bonnets are moved into position against the body.

BRIEF DESCRIPTION OF THE DRAWINGS

These and other objects and advantages of the improved ram-type blowout preventer of the present invention are hereinafter set forth and explained with reference to the drawings wherein.

DESCRIPTION OF THE PREFERRED EMBODIMENTS

Figure 1:
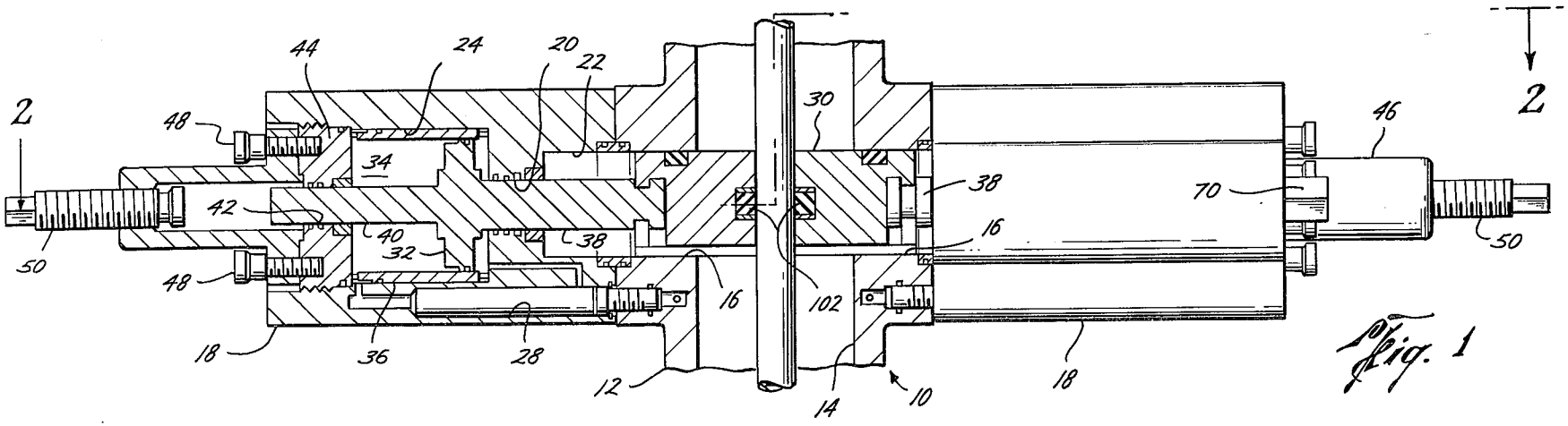
FIG. 1 is an elevation view partly in section of one form of the improved blowout preventer of the present invention.

The improved blowout preventer 10 of the present invention includes body 12 having vertical bore 14 therethrough and aligned opposed guideways 16 extending outwardly therefrom. Bonnets 18, which are secured to body 12 as hereinafter described each include bore 20, aligned guideway extension 22 in communication with bore 20 and guideway 16, outer counterbore 24, side bores 26 extending through bonnet 18 in parallel relationship to bore 20 and opening 28 (shown in FIGS. 1 and 4) extending partially through bonnet 18.

Rams 30 are slidably positioned in guideways 16 and are moved therein from their closed position in which they close bore 14 to their open position in which they are retracted into guideways 16. The movement of each of rams 30 is responsive to hydraulic pressure applied to opposite sides of piston 32 in cylinder 34 formed within outer counterbore 24 by sleeve 36. Piston 32 is connected to ram 30 by rod 38 which extends through bore 20 and engages into the back side of ram 30 as shown. Rod 40 extends from the opposite side of piston 32 through bore 42 in closure plate 44 and terminates within cap 46. Closure plate 44 is threaded into the outer end of counterbore 24 and cap 46 is secured to plate 44 by cap screws 48. Stop 50 is threaded through cap 46 and is adjusted to be engaged by the end of rod 40 at the desired outer end of the opening stroke of piston 32 and ram 30.

Figure 2:
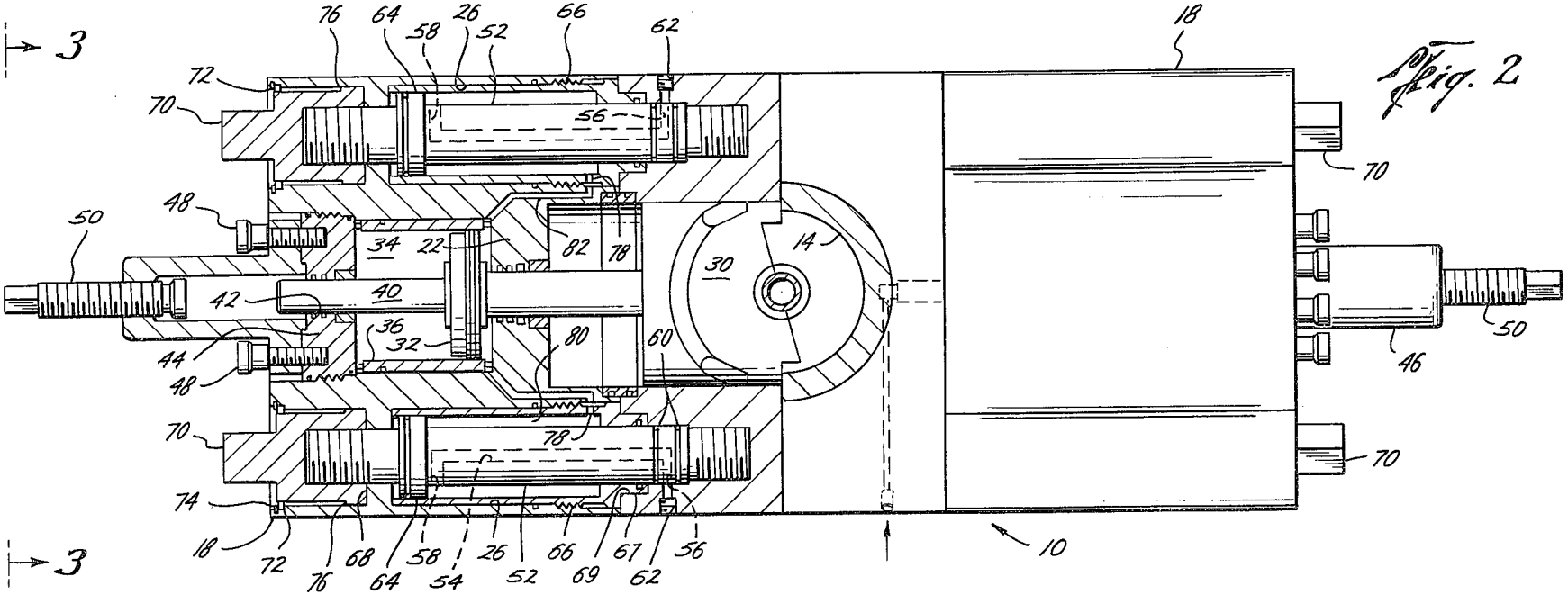
FIG. 2 is a partial sectional, partial plan view taken along line 2—2 in FIG. 1.
Figure 5:
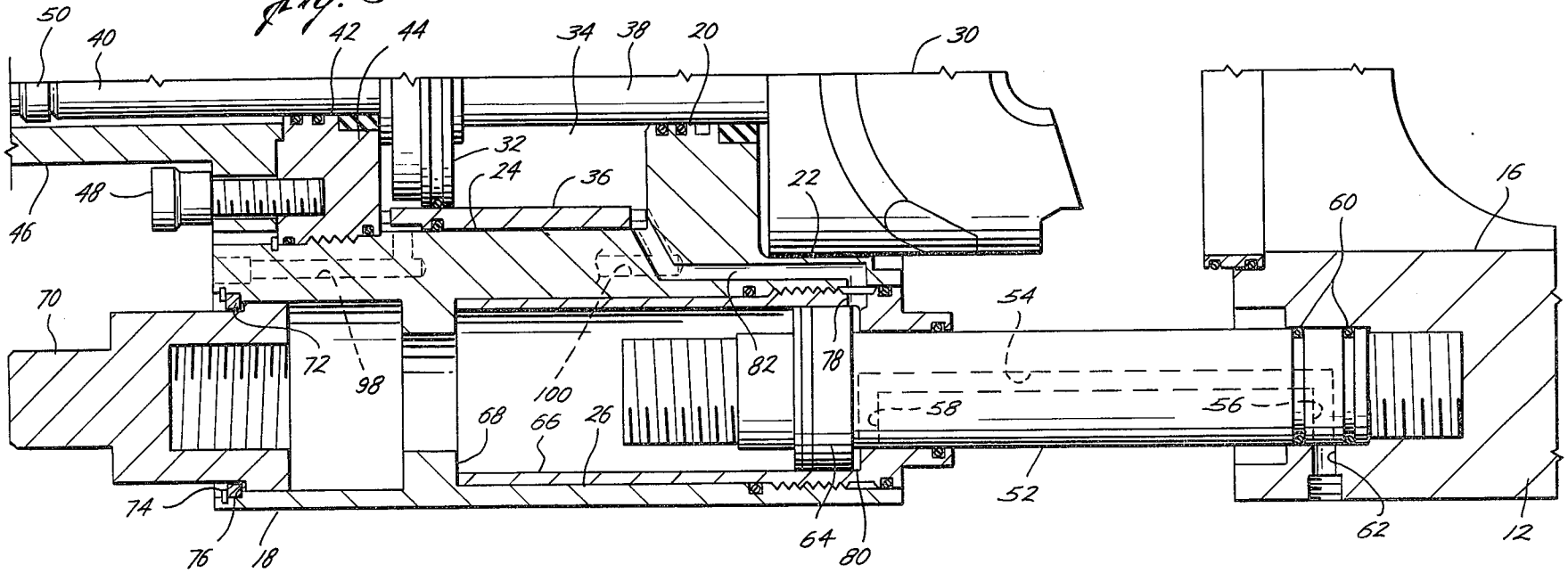
FIG. 5 is a partial sectional view illustrating the bonnet and ram separated from the body and in position for change of the ram packing.

Studs 52 are threaded into body 12 and extend into side bores 26. As best shown in FIGS. 2 and 5, each stud 52 includes central passage 54 with ports 56 and 58 in communication therewith and extending to the exterior of stud 52. Port 56 is positioned between seals 60 and in communication with port 62 extending through body 12. Port 58 is positioned immediately to the body side of flange 64 on stud 52. Sleeves 66 are threaded into side bores 26 and extend from internal flanges 68 into body recess 69 with boss 67 on sleeve 66 positioned in recess 69 and sleeves 66 are in surrounding relationship to each of studs 52. Suitable seals are provided between flange 64 and the interior of sleeve 66, between sleeve 66 and the interior of bore 26 and between the interior of sleeve 66 and the exterior of stud 52 between ports 56 and 58.

When bonnet 18 is secured to body 12, as shown in FIG. 2, nuts 70 are threaded onto the outer ends of studs 52. Nuts 70 are captured within the outer portion of side bores 26 by rings 72 which are held in bores 26 by snap rings 74 positioned in grooves as shown. Rings 72 closely surround the exterior of nuts 70 and engage shoulders 76 on the exterior of each nut 70 to prevent each nut 70 from being inadvertently removed from the outer end of bore 26.

Port 78 extends through sleeve 66 to provide communication from annulus 80 surrounding each of studs 52 through passage 82 into cylinder 34 on the ram side of piston 32. Thus, hydraulic pressure applied to port 62 is exerted in annulus 80 to urge sleeve 66 and bonnet 18 toward body 12 and place studs 52 in tension. This pressure is also transmitted to cylinder 34 to force piston 32 outward and thereby move ram 30 to its open position. Thus, such structure provides the pressure responsive means to move bonnet 18 toward body 12 and to hydraulically tension studs 52.

Figure 4:
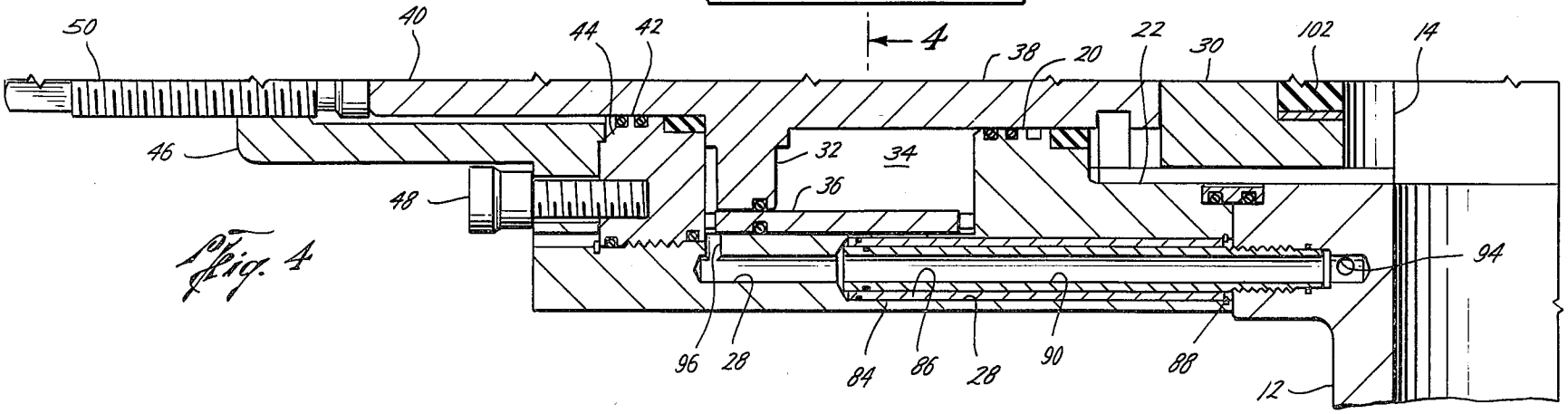
FIG. 4 is a partial sectional view taken along line 4—4 in FIG. 3 and showing the pressure responsive means for moving the bonnet away from the body of the improved blowout preventer.

A pressure responsive means is provided to move bonnet 18 away from body 12. Such means, as best seen in FIG. 4, includes outer sleeve 84 which is held in counterbore 86 by snap ring 88 and inner sleeve 90 which is slidable within outer sleeve 84 and is secured in body 12. The interior of inner sleeve 90 is in communication with port 92 in body 12 through passage 94. Port 96 extends through bonnet 18 into the outer end of cylinder 34. When hydraulic pressure is supplied to port 92, it is delivered through passage 94 to urge bonnet 18 away from body 12 and through port 96 into cylinder 34 to urge piston 32 inward to move ram 30 to its closed position.

If desired, as shown in FIG. 5, alternate passages 98 and 100, which extend through bonnet 18 into opposite ends of cylinder 34 may be used to direct hydraulic pressure to cylinder 34 and to bypass the pressure responsive means previously described. With these passages 98 and 100 in use, passage 82 and port 96 may be omitted to isolate the two hydraulic systems.

Figure 3:
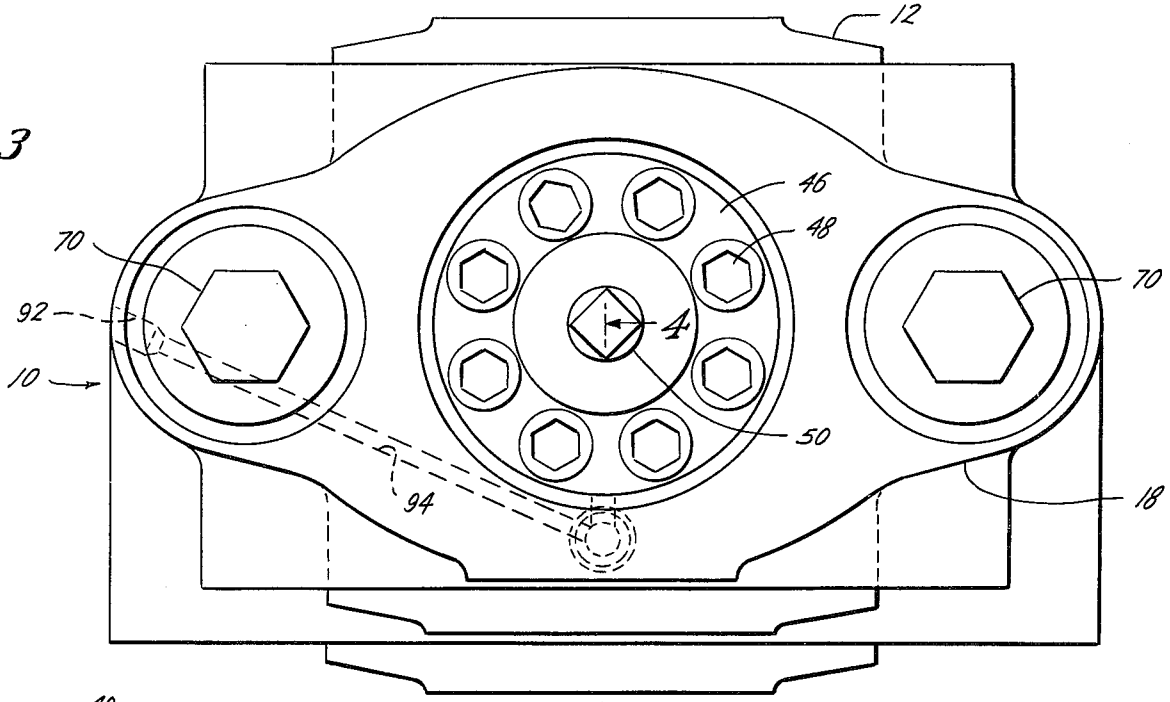
FIG. 3 is an end elevation view taken along line 3—3 in FIG. 2.

With the improved blowout preventer 10 assembled as shown in FIGS. 1, 2 and 3, hydraulic fluid under pressure supplied to each of ports 62 will be transmitted to cylinder 34 on the inner side of piston 32 and will move pistons 32 and rams 30 outward until rod 40 engages stop 50 at which point rams are in their open or retracted position as shown in FIG. 4. To move the rams 30 to closed position, hydraulic fluid under pressure is supplied to port 92 from which it is transmitted to cylinder 34 on the outer side of piston 32.

When packing 102 in rams 30 is to be replaced, nuts 70 are unthreaded from the ends of studs 52 and then hydraulic pressure is supplied to port 92. This pressure is exerted in sleeve 90 and opening 28 to move bonnet 18 outward on studs 52 to the position shown in FIG. 5. With a suitable spacer positioned between bonnet 18 and body 12, pressure is supplied to port 62 to retract rams 30 to the position at which packing 102 may be easily replaced. The rams 30 are then free of body 12 and packing 102 can be readily changed. Bonnet 18 is returned to its position engaging body 12 by supplying hydraulic pressure to ports 62. This pressure in annulus 80 exerts a force on bonnet 18 inward and on flange 64 outward. This pressure not only moves bonnet 18 back into engagement with body 12 but also tensions studs 52. Nuts 72 are tightened on studs 52 while they are still hydraulically tensioned. The torque on nuts 70 to provide a desired stud tension is substantially less than it would be if studs 52 were not hydraulically tensioned.

Figure 7:
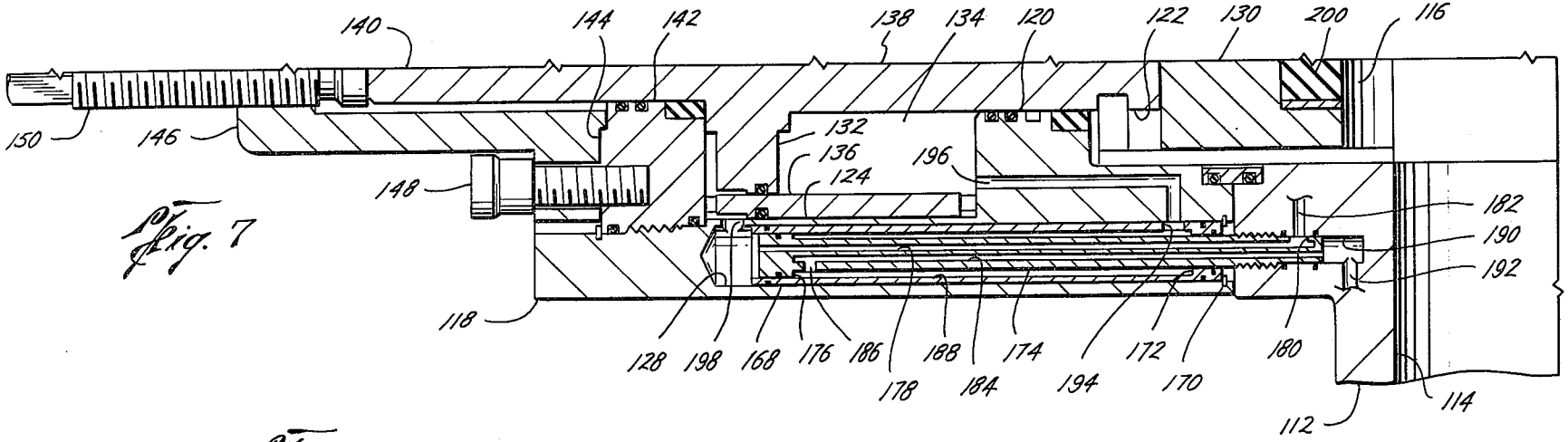
FIG. 7 is a detailed partial sectional view of the modified blowout preventer shown in FIG. 6 to show the pressure responsive means for moving the bonnet away from the blowout preventer body.
Figure 6:
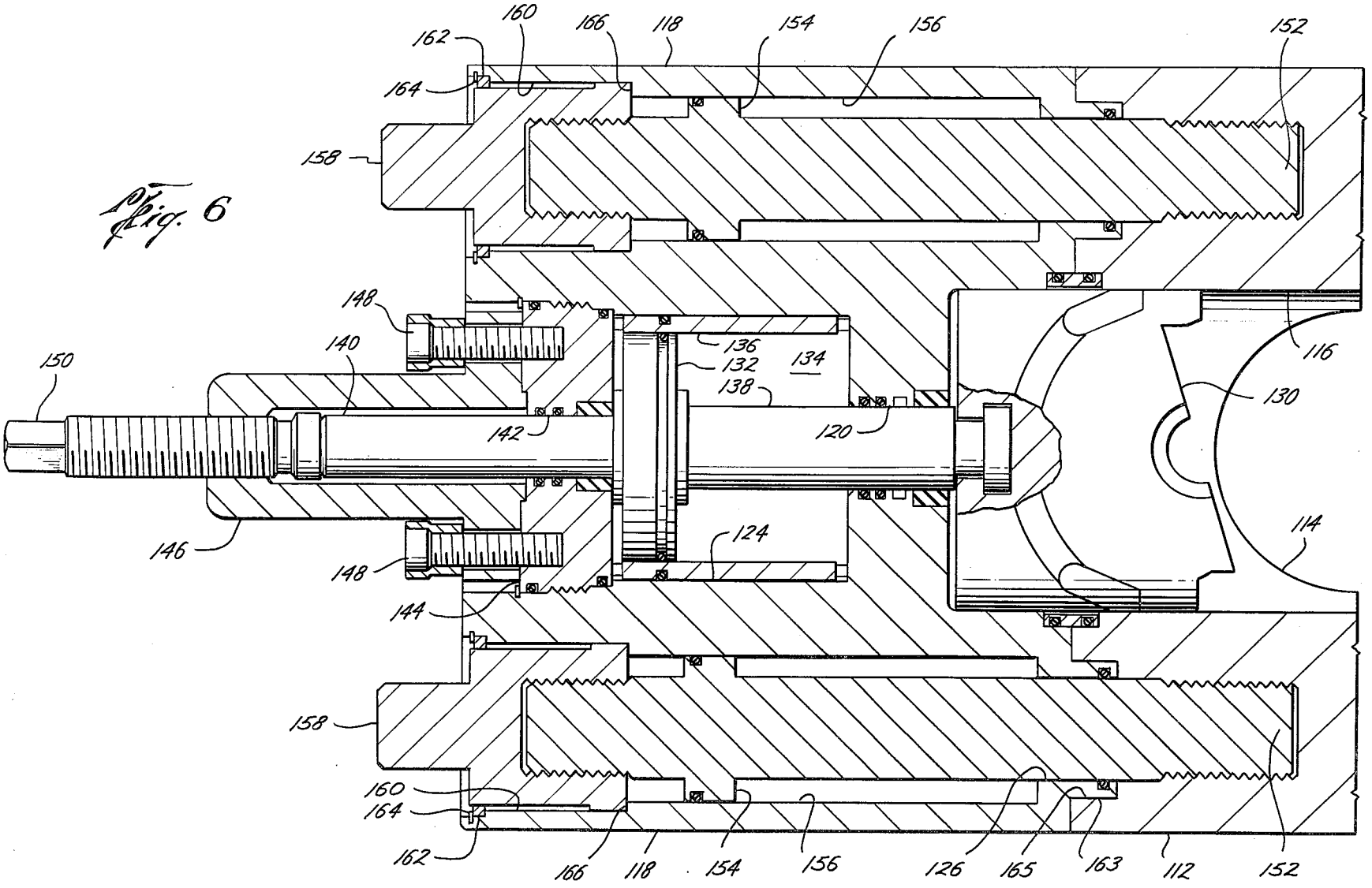
FIG. 6 is a detailed partial sectional view of a modified form of blowout preventer with its ram in its full open position.

The modified blowout preventer 110 shown in FIGS. 6 and 7 is substantially the same as blowout preventer 10 and includes body 112 having vertical bore 114 and opposed guideways 116. Bonnets 118, which are secured to body 112 as hereinafter described, each include bore 120, aligned guideway extension 122 in communication with bore 120 and guideway 116, outer aligned counterbore 124, side bores 126 extending through bonnet 118 in parallel relationship to bore 120 and opening 128 (shown in FIG. 7) extending partially through bonnet 118.

Rams 130 are slidably positioned in guideways 116 and are moved therein from their closed position in which they close bore 114 to their open position in which they are retracted into guideways 116 and extensions 122 as shown in FIG. 6. The movement of each of rams 130 is responsive to hydraulic pressure applied to opposite sides of piston 132 in cylinder 134 formed within outer counterbore 124 by sleeve 136. Piston 132 is connected to ram 130 by rod 138 which extends through bore 120 and engages into the back side of ram 130 as shown. Rod 140 extends from the opposite side of piston 132 through bore 142 in closure plate 144 and terminates within cap 146. Closure plate 144 is threaded into the outer end of counterbore 124 and cap 146 is secured to plate 144 by cap screws 148. Stop 150 is threaded through cap 146 and is adjusted to be engaged by the end of rod 140 at the desired outer end of the opening stroke of piston 132 and ram 130.

Studs 152 are threaded into body 112 and extend into side bores 126. Flanges 154 on each of studs 152 are slidable in counterbores 156. Nuts 158 are captured within outer counterbores 160 by ring 162 and snap ring 164 and engage shoulders 166 between counterbores 160 and 156 when they are threaded onto the studs 152. When bonnet 118 is in engagement with body 112, bosses 163 on bonnet 118 are positioned within recesses 165 in body 112 as shown. Bonnet 118 is free to slide outward on studs 152 as hereinafter described with no seals being provided between bonnet 118 and studs 152. Suitable seals are provided between bonnet 118 and body 112.

The pressure responsive means for moving bonnet 118 toward and away from body 112 are shown in FIG. 7. Such means includes sleeve 168 which is positioned within opening 128, is held in such position by snap ring 170, and has inner flange 172 at its end closest to body 112 and insert 174 which is threaded into body 112, has outer flange 176 at its outer end and is slidable within sleeve 168. Insert 174 includes passage 178 communicating from its port 180, which is in communication with passage 182 in body 112, to its outer end as shown and passage 184 communicating from its port 186 which is in communication with annulus 188 between flanges 172 and 176 to recess 190 in body 112. Passage 192 extends through body 112 into recess 190. Port 194 in sleeve 168 connects annulus 188 to passage 196 which extends to the inner end of cylinder 134. Port 198 in bonnet 118 connects the inner end of opening 128 to the outer end of cylinder 134.

In this modified form of the present invention the above described pressure responsive means function when exposed to hydraulic pressure from passages 182 and 192 to urge bonnet 118 toward body 112 and to urge bonnet 118 away from body 112. Supply of hydraulic pressure through passage 182 is exerted at the outer end of recess 128 and on the outer end of insert 174 to urge bonnet 118 away from body 112 and is also exerted in cylinder 134 to urge piston 132 toward closed position. Supply of hydraulic pressure through passage 192 is exerted in annulus 188 to urge insert flange 176 outward and sleeve flange 172 inward which results in bonnet 118 being urged toward body 112 and is also exerted in cylinder 134 to urge piston 132 outward toward open position.

When the ram packing 200 is to be changed, nuts 158 are unthreaded from studs 152 and then hydraulic pressure is supplied to passage 182 to move bonnet 118 outward on studs 152 away from body 112. If ram 130 does not clear body 112A sufficient distance, it may be retracted by blocking movement of bonnet 118 and supplying hydraulic pressure to passage 192 after passage 182 has been depressurized. When the ram packing has been removed and new packing installed, hydraulic pressure to passage 192 after removal of the structure blocking movement structure moves bonnet 118 on studs 152 into engagement with body 112. Nuts 158 are tightened to provide the desired tension in studs 152 and then blowout preventer 110 is ready for operation.

What is claimed is:

1. A blowout preventer comprising a body having a bore extending therethrough and aligned opposed ram guideways extending outwardly from said bore through said body, a pair of bonnets positioned on opposite sides of said body in covering relationship to the outer openings of said ram guideways, each bonnet having a central cylinder therein, a pair of side cylinders and a pair of openings at each end of said side cylinders, said side cylinders and openings extending through the bonnet in parallel relationship to said central cylinder, said central cylinder being axially aligned with its guideway, a ram in each of said guideways, a rod connected to each ram and extending through the ram guideway and terminating in a piston within the bonnet cylinder, a pair of studs secured within the body spaced to the sides of each ram guideway and extending therefrom in parallel relationship to be received in the openings and side cylinders in the bonnet, means responsive to pressure coacting with said studs in said side cylinders to move said bonnets toward and away from said body supported on said studs and to pretension said studs when the bonnet is held against said body, a nut threaded on each stud to secure the bonnets to the body, said pressure responsive means including a flange extending radially outward from each of said studs in said side cylinders, and means for supplying fluid under pressure to said side cylinders at opposite sides of said flange.

2. A blowout preventer according to claim 1 wherein said pressure responsive means also includes a recess in each of the bonnets, a tubular sleeve secured to the body and slidably positioned in said recess, and means for delivering pressure to the interior of the sleeve and to said recess to urge the bonnets away from the body.

3. A blowout preventer according to claim 1 wherein said pressure responsive means also includes a recess extending into each of the bonnets from their body engaging faces, an insert secured in the body and extending into said recess, said insert and the bonnet coacting to form an annulus therebetween, means for delivering pressure to each of said annuli to urge the bonnets toward the body, and means for delivering pressure to each of said recesses beyond the outer end of said inserts to urge the bonnets away from the body.

4. A blowout preventer comprising a body having a bore extending therethrough and aligned opposed ram guideways extending outwardly from said bore through said body, a pair of bonnets positioned on opposite sides of said body in covering relationship to the outer openings of said ram guideways, each bonnet having a central cylinder therein, a pair of said cylinders and a pair of openings at each end of said side cylinders, said side cylinders and openings extending through the bonnet in parallel relationship to said central cylinder, said central cylinder being axially aligned with its guideway, a ram in each of said guideways, a rod connected to each ram and extending through the ram guideway and terminating in a piston within the bonnet cylinder, a pair of studs secured within the body spaced to the sides of each ram guideway and extending therefrom in parallel relationship to be received in the openings and side cylinders in the bonnet, means responsive to pressure coacting with said studs in said side cylinders to move said bonnets toward and away from said body supported on said studs and to pretension said studs when the bonnet is held against said body, a nut threaded on each stud to secure the bonnets to the body, mean for delivering closing pressure to each central cylinder to move the pistons and rams to closed position, and means for delivering opening pressure to each central cylinder to move the pistons and rams to open position, means connecting said opening pressure delivering means to said pressure responsible means to tension said studs and urge the bonnet toward the body whereby said studs and said pressure responsive means function as hydraulic tensioners when the nuts are tightened on the studs during assembly of the bonnet to the body.

5. A blowout preventer comprising a body having a bore extending therethrough and aligned opposed ram guideways extending outwardly from said bore through said body, a pair of bonnets positioned on opposite sides of said body in covering relationship to the outer openings of said ram guideways, each bonnet having a central cylinder therein, a pair of side cylinders and a pair of openings at each end of said side cylinders, said side cylinders and openings extending through the bonnet in parallel relationship to said central cylinder, said central cylinder being axially aligned with its guideway, a ram in each of said guideways, a rod connected to each ram and extending through the ram guideway and terminating in a piston within the bonnet cylinder, a pair of studs secured within the body spaced to the sides of each ram guideway and extending therefrom in parallel relationship to be received in the openings and side cylinders in the bonnet, means responsive to pressure coacting with said studs in said side cylinders to move said bonnets toward and away from said body supported on said studs and to pretension said studs when the bonnet is held against said body, a nut threaded on each stud to secure the bonnets to the body, said nuts are positioned in each of the outer openings in said bonnets, said nuts are rotatable in their respective openings to thread onto said studs for securing each of said bonnets to said body, and releasable means for retaining said nuts in said openings independent of said studs.

* * * * *